US007357474B2

(12) United States Patent
Gröninger et al.

(10) Patent No.: US 7,357,474 B2
(45) Date of Patent: Apr. 15, 2008

(54) METHOD OF CONTROLLING AN INKJET PRINTHEAD, AN INKJET PRINTHEAD SUITABLE FOR USE OF SAID METHOD, AND AN INKJET PRINTER COMPRISING SAID PRINTHEAD

(75) Inventors: Mark Alexander Gröninger, Venlo (NL); Pieter Gijsbertus Maria Kruijt, Eindhoven (NL); Hans Reinten, Velden (NL); Ronald Herman Schippers, Venlo (NL); Johannes Mathieu Marie Simons, Venlo (NL)

(73) Assignee: Océ-Technologies B.V., Venlo (NL)

( * ) Notice: Subject to any disclaimer, the term of this patent is extended or adjusted under 35 U.S.C. 154(b) by 45 days.

(21) Appl. No.: 10/612,069

(22) Filed: Jul. 3, 2003

(65) Prior Publication Data

US 2004/0051750 A1 Mar. 18, 2004

(30) Foreign Application Priority Data

Jul. 5, 2002 (NL) ..... 1021013

(51) Int. Cl.
*B41J 29/393* (2006.01)

(52) U.S. Cl. ..... 347/19; 347/9; 347/10

(58) Field of Classification Search ..... 347/9, 347/19, 14, 10, 5; 310/315

See application file for complete search history.

(56) References Cited

U.S. PATENT DOCUMENTS

| | | | | |
|---|---|---|---|---|
| 4,866,326 | A * | 9/1989 | Niikawa et al. | 310/315 |
| 5,757,392 | A * | 5/1998 | Zhang | 347/14 |
| 6,168,252 | B1 | 1/2001 | Yaji | 347/14 |
| 6,375,299 | B1 | 4/2002 | Foster et al. | 347/19 |

FOREIGN PATENT DOCUMENTS

| | | | |
|---|---|---|---|
| EP | 0 790 126 | A1 | 8/1997 |
| EP | 1 013 453 | A2 | 6/2000 |
| JP | 10-235860 | * | 9/1998 |
| WO | WO01/36202 | A1 | 5/2001 |

* cited by examiner

*Primary Examiner*—Lam Son Nguyen
(74) *Attorney, Agent, or Firm*—Birch, Stewart, Kolasch & Birch, LLP

(57) ABSTRACT

A method of controlling an inkjet printhead containing a substantially closed duct in which ink is situated, said duct having at least one exit opening for the ink, wherein an actuation pulse is applied to an electro-mechanical transducer so that the pressure in the duct changes in such a manner than an ink drop is ejected from the exit opening, wherein the method further comprises: measuring the electric impedance of the electromechanical transducer and adapting the actuation pulse on the basis of the measured impedance.

7 Claims, 5 Drawing Sheets

METHOD OF CONTROLLING AN INKJET PRINTHEAD, AN INKJET PRINTHEAD SUITABLE FOR USE OF SAID METHOD, AND AN INKJET PRINTER COMPRISING SAID PRINTHEAD

This non-provisional application claims priority under 35 U.S.C. § 119(a) on Patent Application No. 1021013 filed in The Netherlands on Jul. 5, 2002, which is herein incorporated by reference.

BACKGROUND OF THE INVENTION

1. Field of the Invention

The present invention relates to a method of controlling an inkjet printhead containing a substantially closed duct in which ink is situated, said duct having an exit opening for the ejection of ink, wherein an actuation pulse is applied to an electromechanical transducer so that the pressure in the duct changes in such a manner than an ink drop is ejected from the exit opening. The present invention also relates to an inkjet printhead suitable for applying the present method and an inkjet printer containing such a printhead.

2. Related Art

A method of this kind is known from EP 0 790 126. The known method is used in a printhead for an inkjet printer, in which the printhead contains a duct plate in which a number of parallel grooves are formed in a longitudinal direction, each groove terminating in an exit opening or nozzle. The duct plate is covered by a flexible plate so that the grooves form substantially closed ink ducts. A number of electromechanical transducers are provided on the flexible plate at the ducts so that each duct is confronted by one or more of these transducers. The transducers, in this case, piezoelectric transducers, are provided with electrodes. When a voltage is applied in the form of an actuation pulse across the electrodes of the piezo-electric transducer of this kind, a sudden deformation of the transducer occurs in the direction of the associated duct, so that the pressure in that duct increases suddenly. As a result, a drop of ink is ejected from the nozzle.

On the side remote from the duct plate, the transducers are supported by a carrier member. The printhead is also provided with a number of connecting elements which connect the carrier member via the flexible plate to the duct plate. These connecting elements serve to increase the mechanical strength of the printhead so that an applied actuation pulse will also always result in the required pressure rise and thus the required drop ejection, i.e. a drop ejection in which the drop, for example, has a previously known size and/or previously known speed.

The use of the known method in known printheads therefore leads to a stable printing process.

The known method has a number of disadvantages however. Firstly, no matter how rugged the construction of a printhead, it will always age. Not only will material properties and particularly the expansion characteristic of the electromechanical transducer slowly change in the course of time, but the mechanical construction itself is also subject to change. Thus connections between the different constituent parts of the printhead, particularly glued connections, may acquire different mechanical properties or even bercome detached. All this has the result that a specific actuation pulse will in the course of time give a different drop ejection. In other words, the known method results in a decline in print characteristics.

Another disadvantage of the known method is that the maximum frequency at which drops can be ejected is limited. A subsequent drop cannot be ejected until the pressure change as a result of the previous drop has sufficiently decayed. Actuation of the transducer in fact usually results in a pressure change in the form of a damped sine wave. Only when the sine wave has been sufficiently damped will it not have an adverse effect on the next drop formation. This damping takes time and thus limits the maximum attainable drop frequency and thus restricts the maximum attainable print speed possible with the known method.

Another disadvantage of the known method is that crosstalk still occurs between the ducts. Although it is limited, particularly in applications where a very high quality is required, it is a significant disadvantage. Finally, it is a disadvantage that the known method requires the use of a printhead having little freedom with respect to design. The construction must satisfy strict mechanical requirements to provide a reliably stable drop formation. This makes it difficult and particularly expensive to use the known method.

SUMMARY OF THE INVENTION

The object of the present invention is to obviate the above disadvantages. To this end, a method has been developed which includes the steps of measuring the electric impedance of the electromechanical transducer, and adapting the actuation pulse on the basis of the measured impedance. In the method according to the present invention, the impedance, i.e. the current/voltage characteristic, of the electromechanical transducer is measured in order to adapt the actuation pulse itself. In other words, the impedance of the transducer is measured during the application of the pulse, so that the effect of this pulse can be determined simultaneously with its application (real-time). In this way it is possible to adapt the pulse during the application thereof if necessary in order to achieve a desired pressure change. If, for example, it is found at the start of the pulse that the pressure is increasing much too rapidly, no matter why, then the pulse can be adapted by weakening it in its further course.

The present invention makes use of the realization that the electric impedance of the electromechanical transducer is dependent on the same parameters as those that determine the pressure change in a duct as a result of a specific actuation pulse. The electromechanical transducer in fact is mechanically coupled to the pressure in the duct, which pressure in turn depends on the construction of the printer and the conditions under which it is used. By measuring the electric impedance of the transducer it is thus possible to generate information coupled to the construction and conditions. Examples of parameters coupled thereto are, for example, the mechanical association of components and also how this association is at a specific moment in time, and also the actuation of neighboring transducers, the pressure in the duct, the temperature of the head, the viscosity of the ink, and so on. By measuring the electric impedance of the transducer and determining therefrom the effect achieved in the duct, for example the pressure change, it is thus possible to measure the influence of all these parameters. The actuation pulse itself can then be updated to give the finally required drop ejection.

By using the method according to the present invention, ageing of the printhead no longer has a noticeable effect on the drop ejection. Any influence that ageing has on the drop ejection process can in fact be corrected by the application of the present method. For example, if the actuation pulse results in a pressure build-up which is less intensive or even more intensive than required, due to wear of the printhead (for example reduction of the expansion of the transducer in response to a given pulse, wear of the exit opening, weakening of the flexible plate, cracks in the head, connections working loose, and so on), the actuation pulse can be updated during application so that the correct pressure build-up is achieved. The compensation of the effects of ageing can be effected by updating each actuation pulse. This can also be effected by measuring the effect of ageing at certain times, for example during a service call, and adapting the actuation pulses to said measurement. The latter embodiment is easy to implement and is often sufficient if the printhead is not ageing rapidly.

The jetting frequency can be made much higher using the method according to the present invention. Damping of the pressure build-up can in fact be actively accelerated by adapting the actuation pulse. For example, by so forming the actuation pulse after the drop ejection that it yields a pressure wave opposed to the pressure wave of the kind passing through the duct, the damping can take place in a much shorter time. As a result, the next actuation pulse can be applied more quickly. It is also possible to let the next actuation pulse take place quickly in any manner whatsoever, i.e. without a distinctly active damping, after a prior drop ejection and correct, during the following pulse, the effect of the pressure wave still running from the previous pulse.

Cross-talk, i.e. the influencing of the drop ejection process in one duct by the actuation of another duct, can also be readily obviated by use of the method according to the invention. If actuation of a transducer in one duct has an effect on the state in a neighboring duct, the effect in the neighboring duct can be corrected by adapting the actuation pulse there in the manner indicated hereinabove.

It should be apparent that through the application of the method according to the present invention, the requirements established in the construction of a printhead will be much less stringent. Any influence that a specific construction has on the drop ejection process can, in fact, be corrected by adapting the actuation pulse system of the present invention. An adaptation of this kind is necessary if it is found that the actuation pulse causes an effect that deviates appreciably from the desired effect, for example a pressure build-up which is lower or higher, or a pressure which is damped less quickly than is desired for an adequate drop ejection process, i.e. a process for generating a desired print quality.

European Patent Application EP 1 013 453 discloses a method in which a piezo-electric transducer is used as a sensor to measure the state of the associated ink duct. In this method, after the expiration of the actuation pulse, the transducer is used as a sensor to measure the pressure waves in the duct. However, this method is applied to check the state of the duct in order to decide whether it is necessary to carry out any repairs. From this application it is not known to adapt the actuation pulse itself. Nor is it known to measure the impedance of the transducer. Thus, the European patent application is remote from the present invention.

In one embodiment, a voltage pulse is applied to the electromechanical transducer and the current passing through the transducer as a result of this voltage pulse and the pressure build-up in the duct are measured. In this way it is clearly possible to determine the current/voltage characteristic of the transducer. It should be noted that this voltage pulse may have any desired shape suitable for energizing the transducer. If desired, the pulse will consist of a number of discrete pulses applied successively.

In another embodiment, a current pulse is applied to the electromechanical transducer so that a voltage pulse is formed, by means of which the transducer is energised. By measuring the voltage it is also possible in this embodiment to determine the current/voltage characteristic of the transducer. Also, in this embodiment, the current pulse may be a combination of a number of separate pulses, for example one positive pulse and one negative pulse (which in the case of a first order capacitative impedance of the transducer will result in one separate voltage pulse). The essence of this embodiment is that the current is applied in any manner whatsoever and the resulting voltage is measured.

In one embodiment, the method is used to attain, at a predetermined time, the pressure required to eject an ink drop at a specific speed. This method is advantageous because, in this way, it is possible to control the time of drop ejection. This is important in an inkjet printer because it often has a printhead which is moved with respect to the receiving material in order to scan the entire surface of the receiving material. If the drop ejection time and drop speed are fixed, the drop can be placed on the receiving material at an exact location. This is important for obtaining good print quality.

In one embodiment the method is used to change the pressure after ejection of the drop. In this method, the pressure after ejection of the drop is changed to a value sufficient to correct the drop ejection of subsequent drops. This is also advantageous because, in this way, a good state can always be created in the duct before a following drop is ejected. For example, if it is necessary for the next drop to have an extraordinary size, then it is already possible to create a state in the duct to facilitate the formation of such a drop.

In a further form of this embodiment, the pressure, after the ejection of the drop, is brought substantially to a reference value. In this embodiment, the duct is brought into a state suitable, for example, for the most frequent drop ejection. In this way it is possible to save considerable computing time and good drop ejection will generally be attained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
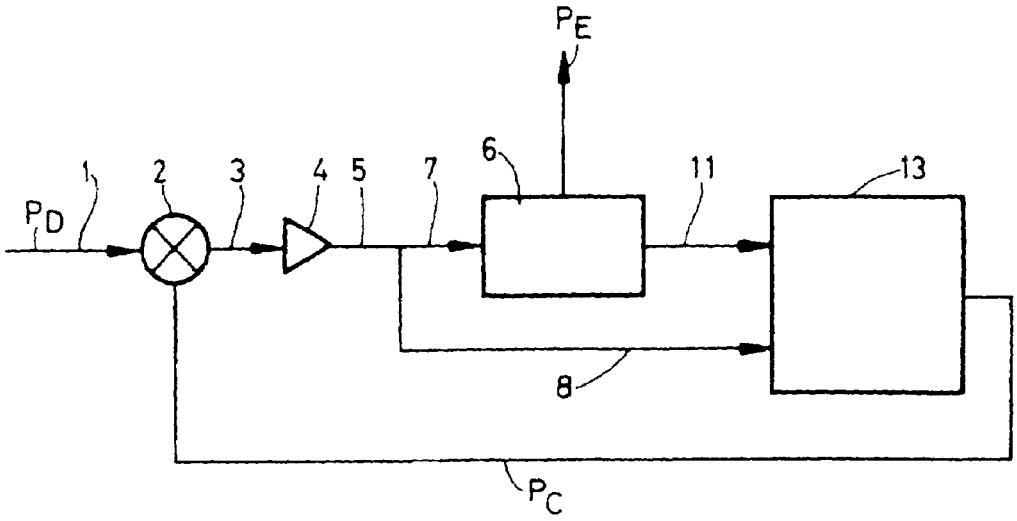
FIG. 1 diagrammatically illustrates the method according to the present invention.

FIG. 1 diagrammatically illustrates an example of the method according to the present invention. The method according to this embodiment starts from a desired pressure $P_D$, indicated by reference 1, which is to be attained in an ink duct to generate a correct drop ejection. This desired pressure $P_D$ is the input signal to a subtracter 2. The desired pressure is translated into a signal 3 for an amplifier 4, which on the basis thereof will feed an actuation voltage 5 to a piezo-electric transducer 6. This voltage is fed to a port 7 of the transducer and, via a connection 8, to a unit 13. In response thereto, the transducer will undergo deformation and attain a pressure $P_E$ (effective pressure) in the relevant ink duct. This pressure cannot be measured directly. However, as a result of the pressure $P_E$ in the duct the transducer will undergo deformation and thus generate a current which is fed via a connection 11 to unit 13. Using the incoming signals the unit 13 can measure in real time the current/voltage characteristic of the transducer. Using a suitable model it is possible to calculate therefrom a value for the pressure $P_E$, and this value is designated $P_C$ (calculated pressure). A model of this kind can readily be made on the basis of an analysis of the construction of the printhead and the electromechanical properties of the transducer. Modeling of this kind is sufficiently known from the prior art. The calculated value $P_C$ is fed to the subtracter 2. The subtracter determines when the calculated pressure $P_C$ corresponds to the desired pressure $P_D$. If not, the signal offered to the amplifier 3 will be adjusted.

Using the above-described closed loop control, it is possible to update the actuation pulse in real time in order to achieve the desired effect at all times. The present invention is not restricted to obtaining the desired pressure in the duct. In principle, it is possible to determine any parameter influencing the drop ejection process via the impedance of the piezo-electric transducer. This means that updating is also possible for the influence that a parameter of this kind has on the drop ejection process.

Figure 2:
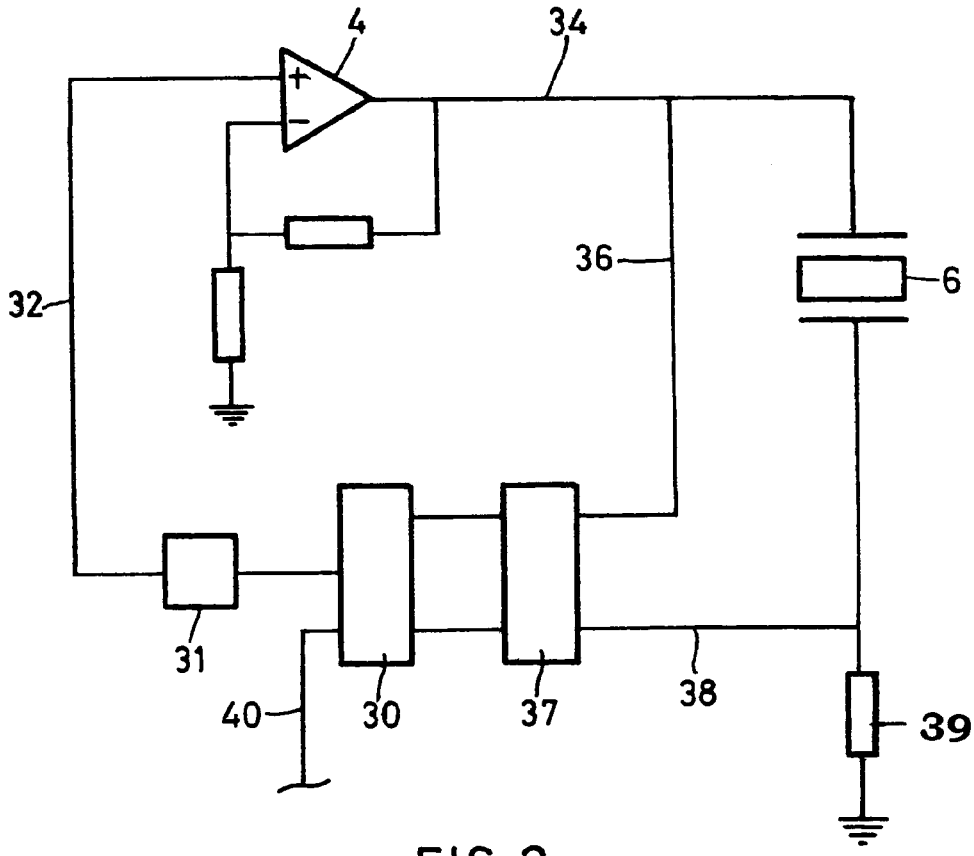
FIG. 2 is an electric analogue of the method according to the present invention.

FIG. 2 shows an electrical analogue of the method according to the present invention. The central unit in this diagram is processor 30. The processor, to which input data can be fed via connection 40, for example to control the processor, or which can be read out, determines what signal is to be fed to the piezo-electric transducer 6. For this purpose, it feeds a control signal to the D/A converter 31, which via connection 32 feeds an analogue signal to amplifier 4. This amplifier then feeds the actuation pulse via connection 34 to the transducer 6. The actuation pulse is also fed to A/D converter 37 via line 36. The current generated by the transducer is sent to ground via the measuring resistor 39. The current is measured by measuring the voltage in front of the resistor via connection 38. This voltage is fed via connection 38 to A/D converter 37. The latter feeds both signals in digital form to the processor 30. Using this model, the processor determines whether the incoming pulse gives the desired effect in the duct. If so, the originally planned pulse is continued. If not, it is updated to give the desired effect.

In this way, in addition to an actuation circuit for the piezo-electric transducer, a measuring circuit is also formed for determining the impedance of the transducer, and a control unit (processor 30) for adapting the actuation pulse. In principle, each duct can be actuated, measured and controlled in this way. In one embodiment, one processor unit is used for many tens or even hundreds of ink ducts. The number of processors required for an inkjet printhead with many hundreds of ducts depends, inter alia, on the computing capacity required for the adequate control of the actuation pulses.

Figure 3:
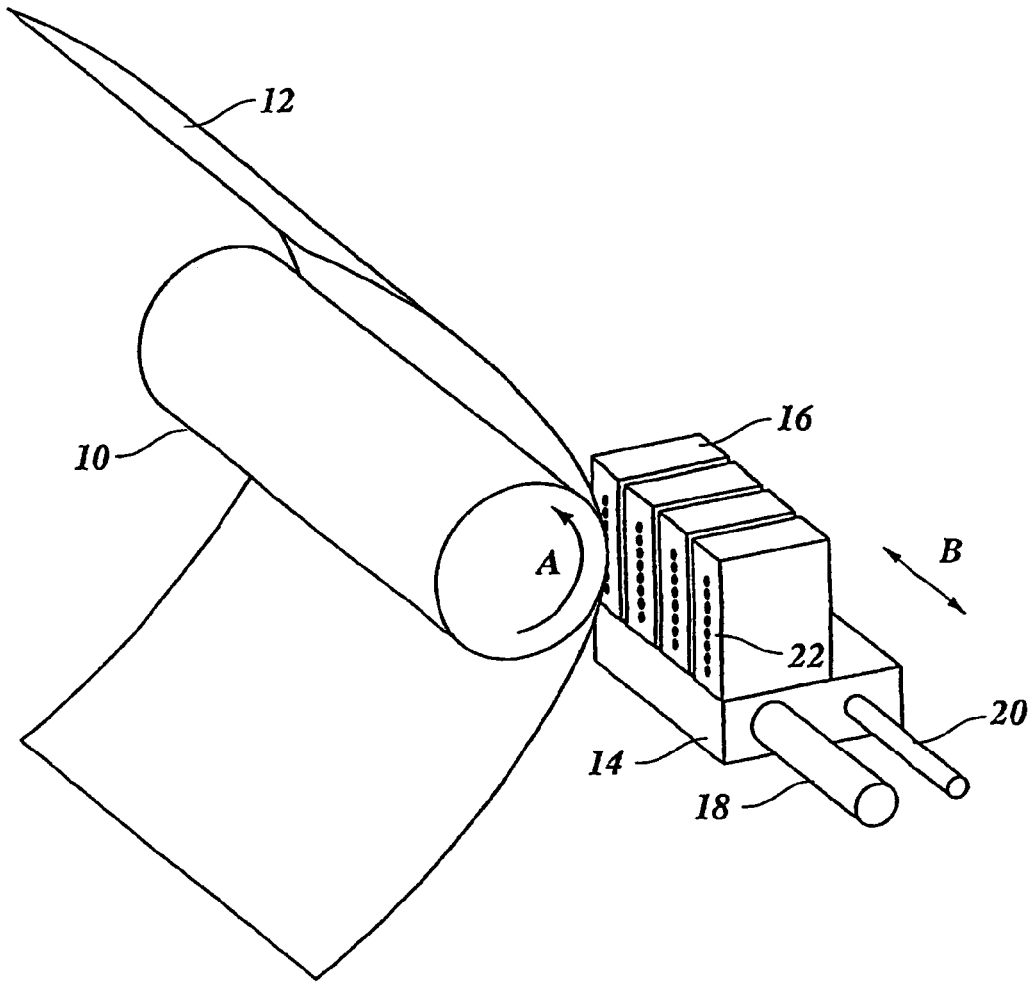
FIG. 3 is a diagram showing an inkjet printer according to the present invention.

FIG. 3 diagrammatically illustrates an inkjet printer. In this embodiment, the printer comprises a roller 10 which supports a receiving medium 12 and moves it along the four printheads 16. The roller 10 is rotatable about its axis as indicated by arrow A. A carriage 14 carries the four printheads 16, one for each of the colors cyan, magenta, yellow and black, and can be moved in reciprocation in a direction indicated by the double arrow B, parallel to the roller 10. In this way the printheads 16 can scan the receiving medium 12. The carriage 14 is guided on rods 18 and 20 and is driven by suitable means (not shown).

In the embodiment as shown in the drawing, each printhead 16 comprises eight ink ducts, each with its own exit opening 22, which form an imaginary line perpendicular to the axis of the roller 10. In a practical embodiment of a printing apparatus, the number of ink ducts per printhead 16 is many times greater. Each ink duct is provided with a piezo-electric transducer (not shown) and associated actuation and measuring circuit (not shown) as described in connection with FIG. 2. Each of the printheads also contains a control unit for adapting the actuation pulses. In this way, the ink duct, transducer, actuation circuit, measuring circuit and control unit form a system serving to eject ink drops in the direction of the roller 10. It is not essential for the control unit and/or for example all the elements of the actuation and measuring circuit to be physically incorporated in the actual printheads 16. It is also possible for these parts to be located, for example, in the carriage 14 or even in a more remote part of the printer, there being connections to components in the printheads 16 themselves. In this way, these parts, nevertheless, form a functional part of the printheads without actually being physically incorporated therein. If the transducers are actuated image-wise, an image forms which is built up of individual ink drops on the receiving medium 12.

Figure 4A:
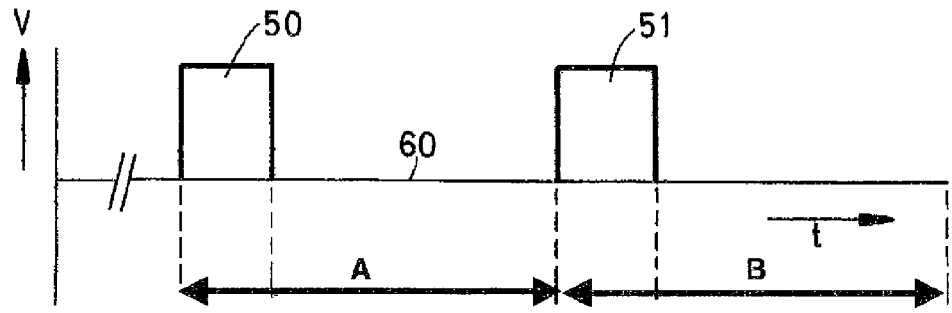
FIGS. 4A-4B diagrammatically illustrate an actuation pulse and the result of a pressure change in an ink duct.
Figure 4B:
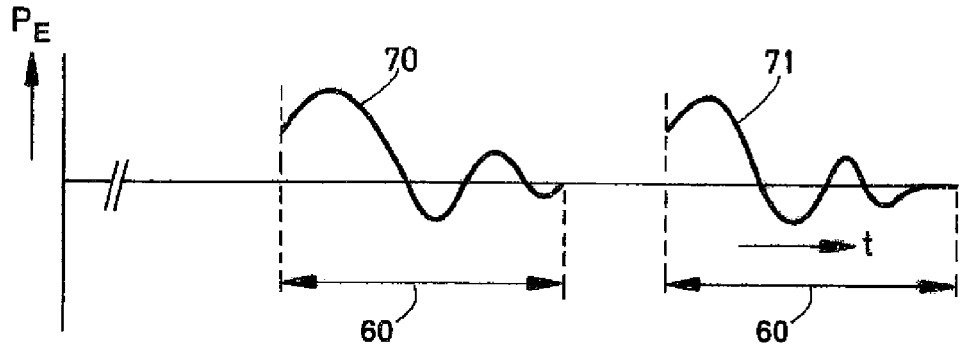

FIG. 4 diagrammatically illustrates an actuation pulse (FIG. 4A) and the resulting pressure change in an ink duct (FIG. 4B).

In FIG. 4A, the applied voltage V is plotted (in arbitrary units) against the time t (in arbitrary units). An actuation pulse is indicated which extends over the area A. This area starts with the application of the voltage to the piezo-electric transducer in the form of a block voltage 50 and ends at the start of the block voltage 51 belonging to a following drop ejection. In this case the actuation pulse also contains a period 60 during which no voltage is fed to the piezo-electric transducer.

FIG. 4B shows the effect of the above-described actuation pulse on the pressure in the associated ink duct. For this purpose, the pressure $P_E$ is plotted (in arbitrary units) against the time t (arbitrary units). Immediately after the start of the period A, the pressure $P_E$ in the duct rises as indicated by curve 70. The pressure reaches a maximum in the area where the actuation pulse contains the block voltage. A drop of ink will be ejected from the exit opening of the duct at around the time that this maximum pressure is reached. After the expiration of the block voltage the pressure drops as indicated. After the expiration of the entire period A the pressure is practically damped to the initial value. The duct is then in the state suitable for generating a subsequent drop ejection.

Figure 5A:
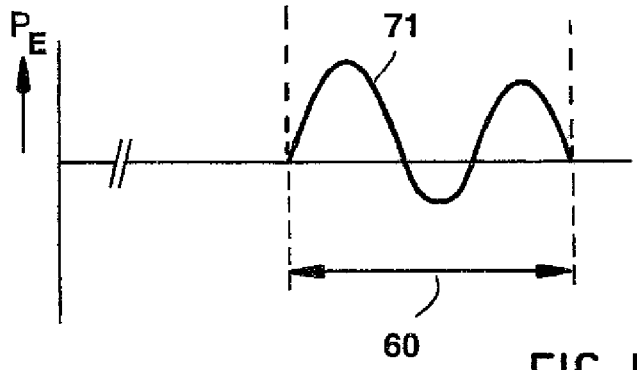
FIGS. 5A-5B show a deviant pressure change and an actuation pulse adapted to prevent such a deviant pressure change.
Figure 5B:
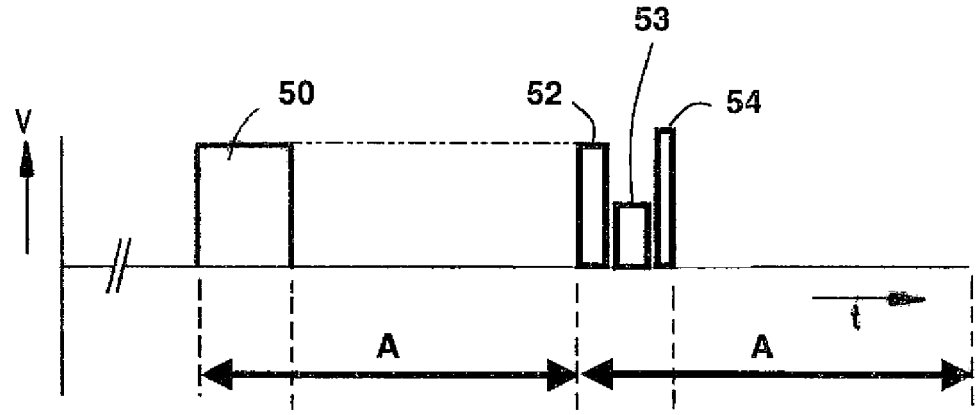

FIG. 5 shows a deviant pressure change (FIG. 5A) and an actuation pulse adapted to compensate for a deviant pressure change of this kind (FIG. 5B).

In FIG. 5A, as in FIG. 4B, a pressure change is shown in an ink duct as a result of an applied actuation pulse in the period A. In this case the pulse results in a pressure curve 71 which is damped only with considerable inertia. The reason for this may, for example, be ageing of the material of the printhead or influence of actuation of a neighboring duct. A curve of this kind means that at the end of period A the pressure is still sufficiently high noticeably to disturb the effect of a following actuation pulse. To obviate such a pressure change, the pulse can be adapted as described via the real-time closed loop shown in FIG. 2. In this case, for example, this could result in an actuation pulse as shown in FIG. 5B. The actuation pulse is now built up of three block voltages 52, 53 and 54, with areas therebetween where no voltage is supplied. This adapted pulse starts with a block voltage 52 practically identical to block voltage 50 in FIG. 4A. In this case too, this block voltage will result in an effective pressure PE causing the ejection of an ink drop. In order actively to accelerate the damping, block voltages 53 and 54 are applied. These voltages do not cause a drop ejection but are directed purely at damping the pressure in the ink duct. In this case, a pulse of this kind results in a pressure curve as shown in FIG. 4B, and in this embodiment that is the desired pressure curve.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A method of controlling an inkjet printhead containing a substantially closed duct in which ink is situated, said duct having at least one exit opening for the ink, which comprises:

setting a required pressure change for obtaining an ink drop ejection in which the drop has a size and speed of which at least one is previously known, applying an actuation pulse to an electro-mechanical transducer so that the pressure in the duct changes, measuring the electric impedance of the electromechanical transducer real time during the application of the said pulse, and real time adapting the said pulse on the basis of the measured impedance to obtain the said required pressure change, thus ejecting from the exit opening said drop caused by the said pulse having the size and speed of which at least one is previously known.

2. The method according to claim 1, wherein the actuation pulse applied to the electromechanical transducer is a voltage pulse, and a reacting current generated by the electromechanical transducer is measured.

3. The method according to claim 1, which is used to attain the pressure required to eject the drop at a specific speed and at a predetermined time.

4. The method according to claim 1, which is used to change the pressure after the ejection of the drop.

5. The method according to claim 4, wherein after the ejection of the drop, the pressure is brought substantially to a reference value.

6. An inkjet printhead containing a substantially closed duct for holding ink, which duet has at least one exit opening for the ink, which comprises:

means for setting a required pressure change for obtaining an ink drop ejection in which the drop has a size and speed of which at least one is previously known, an actuation circuit for applying an actuation pulse to an electromechanical transducer in such a maimer that the pressure in the duct changes, a measuring circuit for measuring the impedance of the electromechanical transducer real time during the application of the said pulse, and a control unit for real time adapting the said pulse on the basis of the measured impedance to obtain the said required pressure change, thus ejecting from the exit opening said drop caused by the said pulse having the size and speed of which at least one is previously known.

7. An inkjet printer provided with the inkiet printhead of claim 6.

* * * * *